United States Patent [19]

Simerman

[11] Patent Number: 4,542,807

[45] Date of Patent: Sep. 24, 1985

[54] NESTABLE SET OF LADDERS

[76] Inventor: John L. Simerman, R.R. #1, Ossian, Ind. 46777

[21] Appl. No.: 539,528

[22] Filed: Oct. 6, 1983

[51] Int. Cl.[4] ..... E06C 1/24

[52] U.S. Cl. ..... 182/178; 182/167

[58] Field of Search ..... 182/178, 167, 166, 195, 182/22, 179

[56] References Cited

U.S. PATENT DOCUMENTS 2,396,028 3/1946 Spayd ..... 182/178

FOREIGN PATENT DOCUMENTS 1596016 8/1981 United Kingdom ..... 182/178

*Primary Examiner*—Reinaldo P. Machado
*Assistant Examiner*—Alvin Chin-Shue
*Attorney, Agent, or Firm*—George A. Gust

[57] ABSTRACT

A stepladder of the folding freestanding type has steps only toward the upper end thereof and has a step deficient region toward the lower end thereof for receiving a smaller stepladder in nesting relation therewith so that the steps of the smaller stepladder provide user access to the steps of the larger stepladder. A nested sequence of such stepladders with all except the smallest one of that sequence being step deficient in a lower region may include several such ladders thereby providing the user with the option of selecting a ladder of a desired height from among several possible heights with the required storage space for the several ladders being the same as the required storage for space for a single ladder of the greatest height. Braces, supports and locking arrangements for fastening each ladder within the step deficient region of the next larger ladder are also disclosed.

2 Claims, 7 Drawing Figures

NESTABLE SET OF LADDERS

BACKGROUND OF THE INVENTION

The present invention relates generally to ladders and more particularly to stepladders of the folding freestanding type.

Conventional folding stepladders are found in most homes and typically several different size stepladders are owned and stored within the home but used only infrequently. A stepladder arrangement of enhanced versatility with the storage space requirements of a single conventional stepladder would be highly desirable.

The idea of using the steps of one ladder to gain access to the steps of another is not new. For example, so called extension ladders are formed from two conventional simple ladders of the type having a pair of elongated side rails joined by a plurality of typically round cross members or rungs. The pair of simple ladders are juxtaposed with a parallel sliding interconnection and a latching mechanism so that one of the simple ladders may be slid upwardly from the other a desired length to form an extended simple ladder of desired height leaning against a wall or other surface. Similarly, a ladder formed from two simple ladders hinged together at respective one ends may be spread apart somewhat at their other ends to form a freestanding stepladder configuration or the hinge may allow one simple ladder section to be pivoted to as to extend generally linearly from the other section to form a simple ladder to be leaned against a wall or other structure which is substantially double the length of the stepladder freestanding configuration. Neither of these known arrangements provides a freestanding stepladder of wide versatility and it is still necessary to have several different size stepladders for normal use.

SUMMARY OF THE INVENTION

Among the several objects of the present invention may be noted, the provision of a plurality of different size stepladders within a single stepladder; the provision of a scheme for nesting a set of ladders which for storage purposes requires the space for only the largest of those stepladders; the provision of a freestanding stepladder structure where the steps of one ladder are used to gain access to those of another; the provision of a set of stepladders having shared or common components to reduce the overall cost, weight and storage space requirements for the set; and the provision of a set of stepladders in accordance with the previous object exhibiting minimal component duplication as well as minimal additional components to marry the set. These as well as other objects and advantageous features of the present invention will be in part apparent and in part pointed out hereinafter.

In general, a stepladder of the folding freestanding type having steps only toward the upper end thereof and having a step free region toward the lower end thereof receives a smaller stepladder in a pocket or cradle arrangement in the step free region so that the steps of the smaller stepladder may be used to gain access to the steps of the larger stepladder.

Also in general and in one form of the invention, a nested sequence of foldable stepladders of varying sizes have all but the smallest step deficient in a region where the steps of the next smaller stepladder supplant that deficiency. Each stepladder may be of the freestanding variety with only the smallest being usable in its normal fashion independent of the others. Normal use of any one of the sequence of ladders requires the inclusion of all of the smaller ladders of that sequence. In such use, all but the largest of the ladders will be in its folded shut configuration while that largest ladder is opened in the manner of a conventional stepladder.

BRIEF DESCRIPTION OF THE DRAWINGS

Corresponding reference characters indicate corresponding parts throughout the several views of the drawing.

The exemplifications set out herein illustrate a preferred embodiment of the invention in one form thereof and such exemplifications are not to be construed as limiting the scope of the disclosure or the scope of the invention in any manner.

DESCRIPTION OF THE PREFERRED EMBODIMENT

Figure 1:
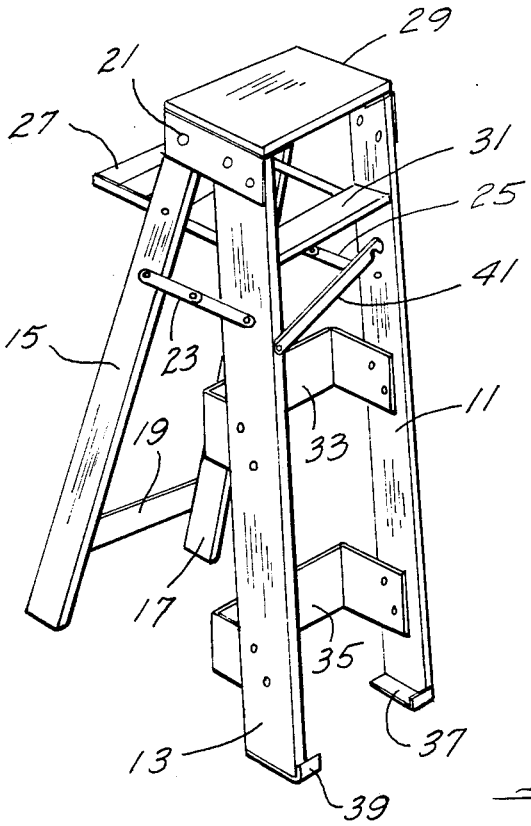
FIG. 1 is a perspective view of the largest of a nested sequence of foldable stepladders in its open or freestanding position with the lesser included stepladders removed to illustrate the pocket or cradle for receiving those smaller stepladders.

The foldable freestanding type stepladder of FIG. 1 has conventional elongated side rails 11, 13, 15 and 17, a conventional stiffening cross member 19 joining a pair of legs or side rails 15 and 17 with those two legs pivoting as at 21 and with the spread between the respective pairs of legs limited by pivotal linkages 23 and 25. A folding shelf 27 for example, to hold a paint bucket may also be included and the stepladder of FIG. 1 includes a conventional uppermost pedestal step 29 along with a cross member step 31. This stepladder as thus far discussed is relatively conventional in its structure, it will be noted, however, that step 31 which is located toward the upper end of the step ladder is in fact the lowest step on that stepladder with the space below step 31 being a step free or step deficient region. Hence this ladder as thus far discussed would be comparatively useless since there is no easy way to ascend the ladder to gain access to the steps 29 and 31.

The step free region within the lower portion of the stepladder of FIG. 1 includes a pair of supports 33 and 35 against which a smaller stepladder is to be leaned as well as a pair of lower leg retainers 37 and 39 upon which the legs of such a smaller stepladder will rest. A pivoting latch 41 is also included on the largest of the stepladders for the purpose of closing and securely holding a smaller stepladder within the pocket or cradle of the ladder FIG. 1.

Figure 2:
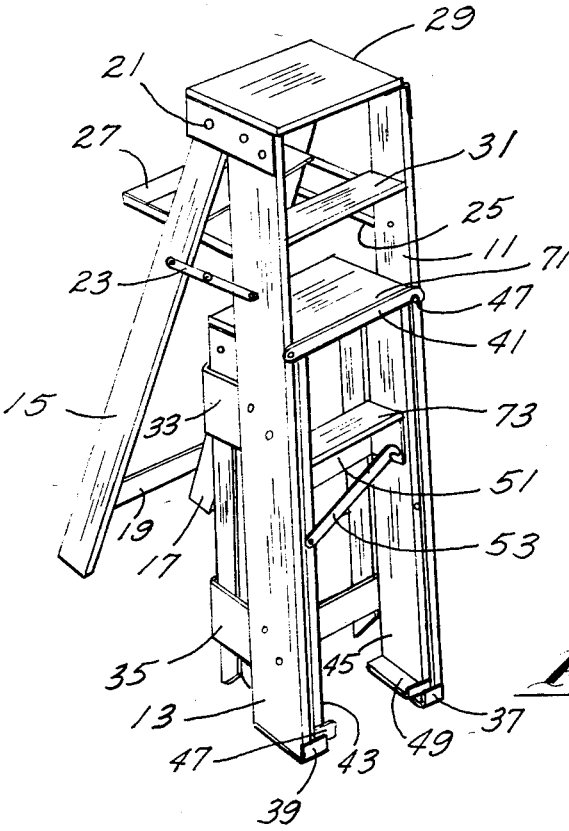
FIG. 2 is a perspective view of the ladder of FIG. 1 with a next smaller stepladder nested therein.
Figure 4:
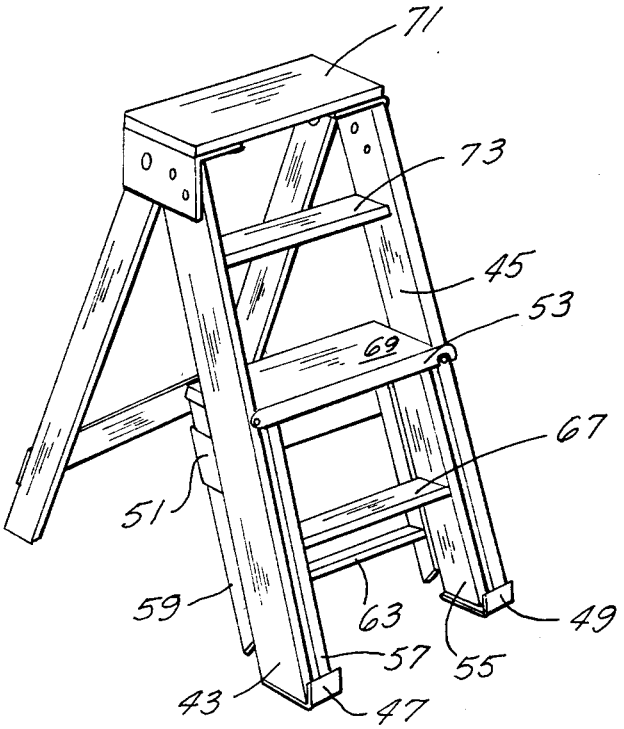
FIG. 4 is a view of the two smaller stepladders of FIG. 3 removed from the largest stepladder of FIG. 1 and unfolded for use.

FIG. 2 illustrates the ladder of FIG. 1 cradling a second ladder of similar configuration but somewhat smaller and in its folded shut position. The front legs 43 and 45 of this smaller ladder rest in the leg retainers 37 and 39 of the largest ladder and the ladder is leaned against the supports 33 and 35 with the latch 41 closed on a pin 47 to securely hold the smaller ladder in its pocket. The smaller ladder includes further leg retainers 47 and 49 and a support 51 similar to the supports 33 and 35 against which a still smaller ladder may be leaned. A latch 53 analogous to the latch 41 of FIGS. 1 and 2 is also included. This smaller ladder is also illustrated in FIG. 4 in its expanded or freestanding position and in that figure is also shown as receiving the still smaller ladder of FIG. 5.

Figure 3:
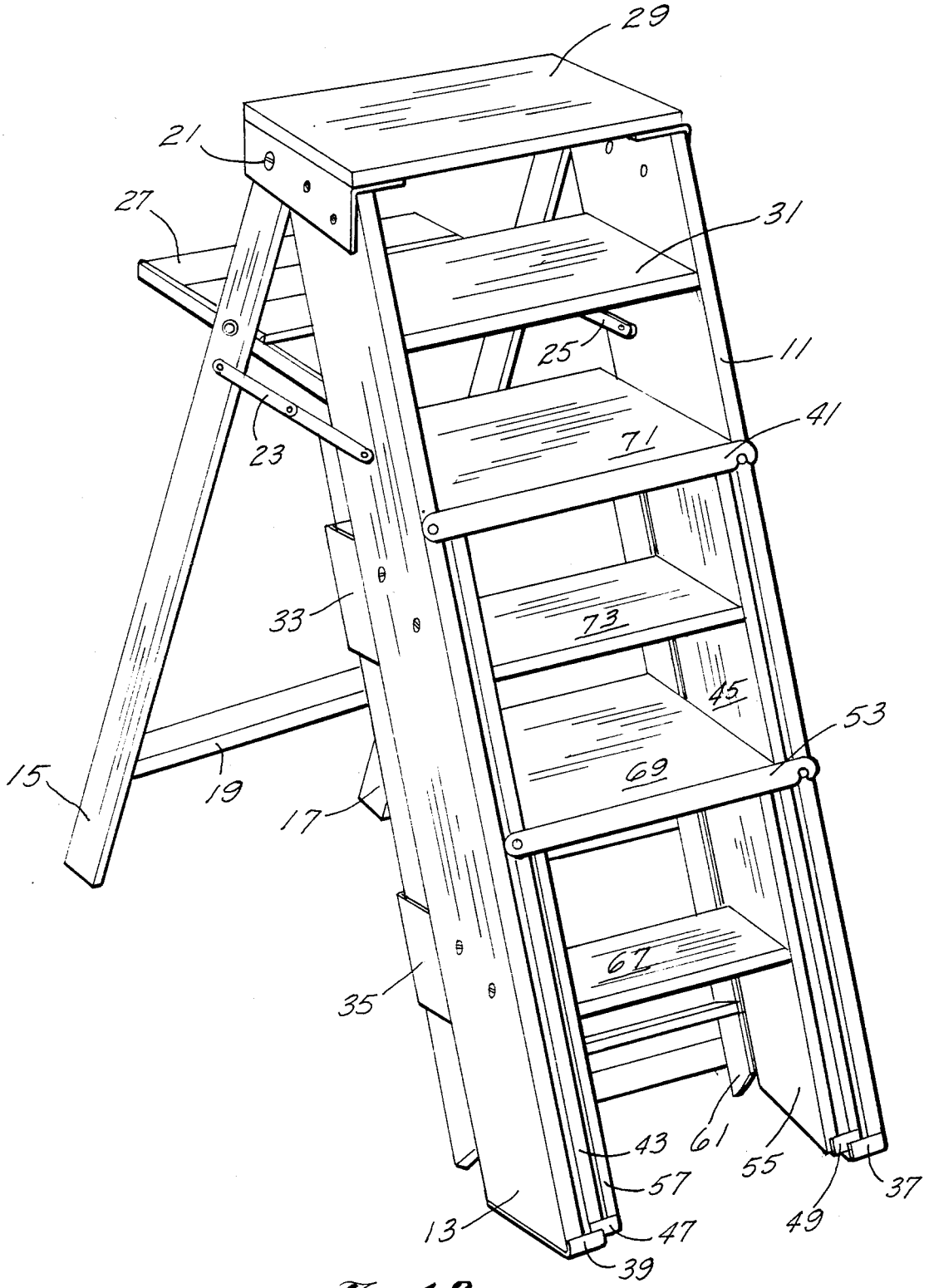
FIG. 3 is a perspective view of the ladders of FIGS. 1 and 2 with a third still smaller stepladder nested therein.
Figure 5:
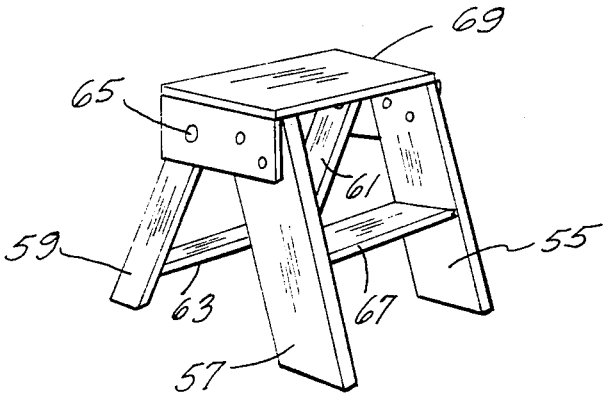
FIG. 5 is a view of the smallest stepladder of FIG. 3 unfolded or expanded for use.

Referring now to FIG. 5 the smallest of the nestable sequence of ladders is seen to be quite conventional and usable in its normal fashion independent of the others. This smallest ladder includes the front elongated side rails 55 and 57 as well as the rear side rails or legs 59 and 61 tied together by a brace 63 and pivotable as at 65. This smallest stepladder includes the cross member step 67 readily accessible by a user from the ground as well as an upper most pedestal step 69. A brace analogous to 23 of FIG. 1 could be included but typically is not necessary. To gain normal access to the upper most pedestal step 71 by way of the cross member step 73 of the intermediate size ladder of FIGS. 2, 3 and 4 the legs 59 and 61 are folded shut about pivot 65 and the smallest ladder of FIG. 5 is nested within the pocket or cradle of the intermediate size ladder resting against support 51 and with the legs thereof supported at the bottom by the leg retainers 47 and 49 as illustrated in FIG. 4. Similarly, if it is desired to gain access to the upper steps 29 and 31 of the largest ladder of FIGS. 1, 2 and 3, the intermediate size ladder of FIG. 4 is folded shut and rested against the supports 33 and 35 with the latch 41 being closed to secure that ladder in its position yielding the overall stairstep arrangement of FIG. 3. Folding shut of the largest ladder now results in a structure which can be stored in the same space as a conventional ladder of that size providing the intermediate size ladder of FIG. 4 and the smallest ladder of FIG. 5 as subassemblies to be removed and used as desired.

Figure 6:
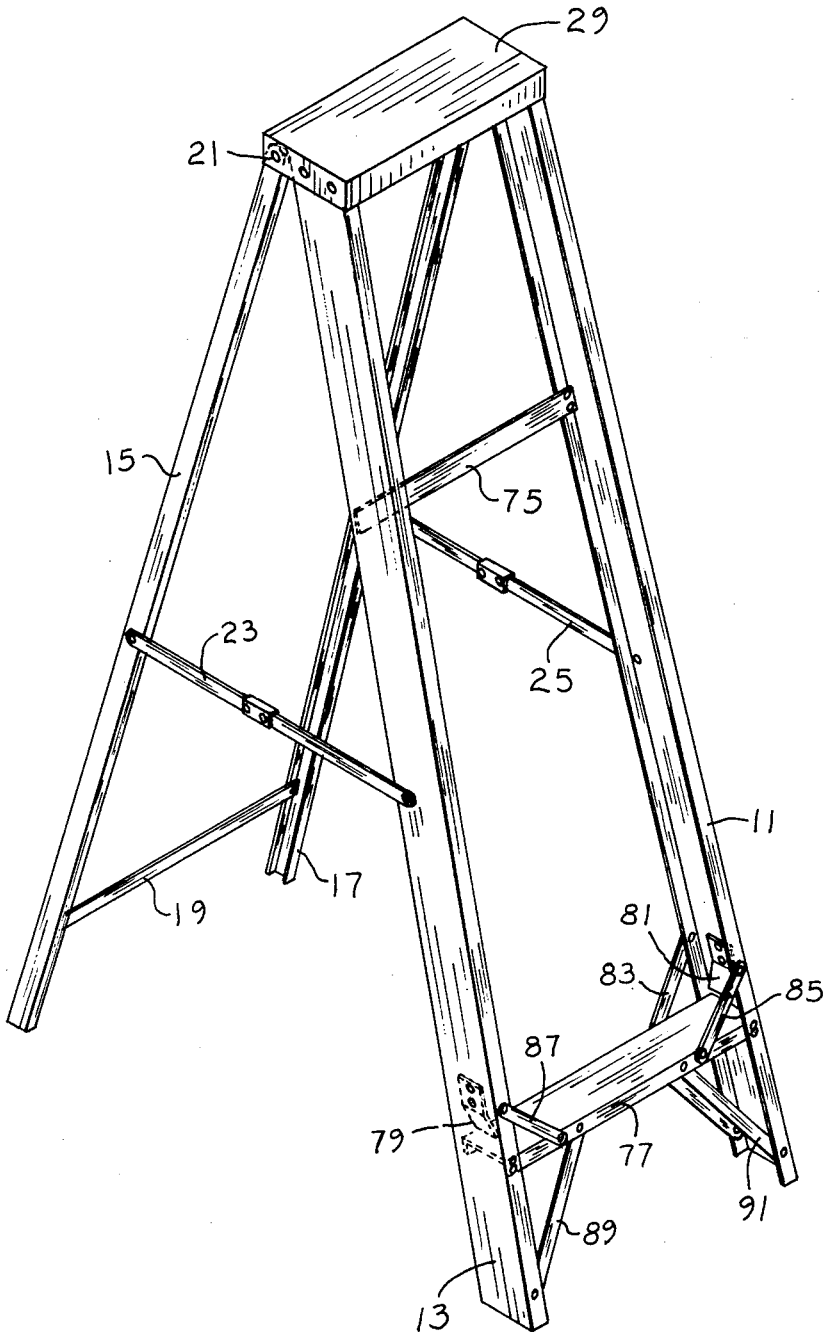
FIG. 6 is a perspective view of a step deficient ladder section showing some of the possible modifications according to the present invention.

The rigidity of the individual ladder sections may in some cases be enhanced by providing one or more of the step deficient ladder sections with a lower most step as illustrated in FIG. 6. Thus in comparing FIGS. 1 and 6 the next to the top step of FIG. 1 has been deleted and a lower most step and associated braces added so that the rest 35 of FIG. 1 which served to define the separation between the lower portions of the front legs of that ladder is no longer employed. Any one of the step deficient ladder sections could be fabricated according to this alternate approach, however for simplicity component reference numerals from FIG. 1 have been carried over into FIG. 6 to identify corresponding components where the nature of that corresponding component is substantially unchanged.

Figure 7:
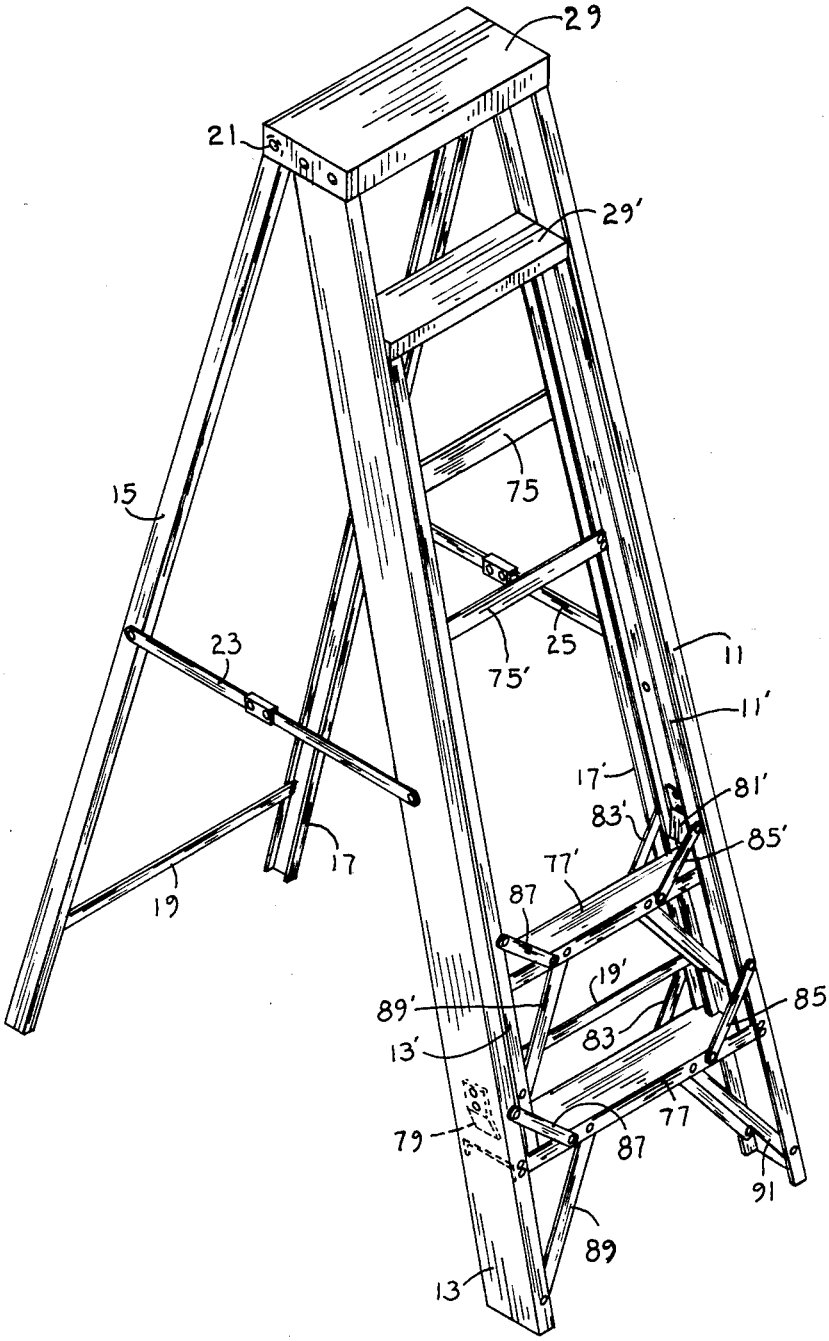
FIG. 7 illustrates the ladder of FIG. 6 with a smaller similar ladder nested therein.

In FIG. 6 the ladder sections happens to be illustrated as being fabricated from aluminum but, of course, any of the versions of the present invention may be fabricated of aluminum, wood or other suitable material. As before the ladder strength and particularly the strength of the generally vertical side rails 11 and 13 will be reinforced by the corresponding generally vertical rails of the other ladder sections to be received within the step deficient pocket with the next smaller ladder section leaning against the brace 75 while resting on the lower most step 77. Spring clips 79 and 81 may be provided to laterally center the next smaller ladder section between the side rails 11 and 13. This is illustrated in FIG. 7 wherein the ladder of FIG. 6 receives an identical but smaller ladder of like construction with corresponding parts bearing corresponding primed and unprimed reference numerals. Thus, FIG. 7 illustrates a sequence of two ladders, each of the type of FIG. 6. The diagonal braces 83, 85, 87 and a brace corresponding to brace 83 not visible in FIG. 6 prevent the feet or lower most portion of the next smaller ladder from being laterally dislodged from its rest position on step 77. Additional diagonal bracing such as 89 and 91 may be provided for enhanced rigidity if desired.

From the foregoing, it is now apparent that a novel folding freestanding stepladder having steps only toward the upper end thereof as well as a novel nested sequence of foldable stepladders of varying sizes only the smallest of which has a complete set of steps has been disclosed meeting the objects and advantageous features set out herein before as well as others. Numerous modifications will immediately suggest themselves to those of ordinary skill in the art. Thus for example, while the nested sequence of stepladders has been illustrated as three stepladders each containing two steps thus providing an overall ladder array of on the order of 6 to 8 feet in height and of adequate height for most normal home uses, the number of ladders as well as the number of steps within any given one of the ladders may be easily modified to suit any particular intended use and to provide an overall ladder array of any reasonable height. Ladder length of 3, 6 and 9 feet as well as ladder lengths of 4, 6 and 8 feet have been found to be particularly well suited for general use. These and other modifications as to the precise configuration shapes and details may be made by those having ordinary skill in the art without departing from the spirit of the invention or the scope thereof as set out by the claims which follow.

What is claimed is:

1. A nested sequence of foldable stepladders of varying sizes each of the free-standing variety and with all except the smallest stepladder being step deficient in a region where steps of smaller stepladders make up for that deficiency by providing steps within the step deficient region of the next larger stepladder, each stepladder except the smallest of the sequence including exactly two steps, one near the top thereof and one near the bottom thereof and with each stepladder in the sequence except the largest thereof resting on the bottom step of the next larger stepladder in the sequence.

2. The sequence of stepladders of claim 1 further comprising means on each of the stepladders having a step deficient region for laterally centering the next smaller stepladder in that step deficient region.

* * * * *